US011859617B2

(12) United States Patent
Tsuka

(10) Patent No.: US 11,859,617 B2
(45) Date of Patent: Jan. 2, 2024

(54) SCROLL COMPRESSOR

(71) Applicant: DAIKIN INDUSTRIES, LTD., Osaka (JP)

(72) Inventor: Yoshitomo Tsuka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 162 days.

(21) Appl. No.: 17/681,506

(22) Filed: Feb. 25, 2022

(65) Prior Publication Data

US 2022/0178373 A1 Jun. 9, 2022

Related U.S. Application Data

(63) Continuation of application No. PCT/JP2020/031324, filed on Aug. 19, 2020.

(30) Foreign Application Priority Data

Sep. 13, 2019 (JP) ..... 2019-167368

(51) Int. Cl.
*F04C 29/02* (2006.01)
*F04C 18/02* (2006.01)
*F04C 23/00* (2006.01)

(52) U.S. Cl.
CPC ..... *F04C 29/02* (2013.01); *F04C 18/0215* (2013.01)

(58) Field of Classification Search
CPC ..... F04C 29/02; F04C 29/028; F04C 29/023; F04C 18/0215; F04C 18/0253; F04C 18/0261; F04C 23/008
See application file for complete search history.

(56) References Cited

U.S. PATENT DOCUMENTS 9,181,945 B2 * 11/2015 Takeda ..... F04C 29/028
2005/0053508 A1 * 3/2005 Morozumi ..... F04C 29/028 418/55.6

(Continued)

FOREIGN PATENT DOCUMENTS

CN 102454603 A 5/2012
CN 103429901 A 12/2013

(Continued)

OTHER PUBLICATIONS

International Search Report of corresponding PCT Application No. PCT/JP2020/031324 dated Nov. 2, 2020.

(Continued)

*Primary Examiner* — Deming Wan
(74) *Attorney, Agent, or Firm* — Global IP Counselors, LLP

(57) ABSTRACT

A scroll compressor includes fixed and movable scrolls forming a compression chamber, a back pressure chamber, and outer and inner oil supply mechanisms that supply oil to outer and inner chambers of the compression chamber. The inner oil supply mechanism includes an oil supply portion formed in a sliding surface of the fixed scroll to communicate with a suction region of the compression chamber and a communication port passing through the sliding surface of the movable scroll to communicate with the back pressure chamber. The communication port communicates with the oil supply portion within a predetermined period in which a center position of a suction-side end of the wrap of the movable scroll in a thickness direction is located radially outward of a center position of a space between adjacent turns of a wrap of the fixed scroll, during one rotation of the movable scroll.

4 Claims, 8 Drawing Sheets

(56) References Cited

U.S. PATENT DOCUMENTS

| | | | | |
|---|---|---|---|---|
| 2008/0267803 | A1* | 10/2008 | Yoo | F04C 18/0253 418/91 |
| 2013/0216416 | A1* | 8/2013 | Takeda | F04C 18/0215 418/55.1 |
| 2014/0010694 | A1 | 1/2014 | Tsuka et al. | |
| 2015/0139844 | A1* | 5/2015 | Akei | F04C 18/0207 418/55.2 |
| 2015/0260189 | A1* | 9/2015 | Kato | F25B 31/004 418/55.2 |
| 2018/0051697 | A1* | 2/2018 | Murakami | F04C 29/028 |
| 2018/0231002 | A1* | 8/2018 | Lee | F04C 29/028 |

FOREIGN PATENT DOCUMENTS

| | | | |
|---|---|---|---|
| CN | 107208634 | A | 9/2017 |
| JP | 2012-77616 | A | 4/2012 |
| JP | 2012-92773 | A | 5/2012 |
| WO | 2012/127795 | A1 | 9/2012 |
| WO | 2016/136185 | A1 | 9/2016 |

OTHER PUBLICATIONS

International Preliminary Report of corresponding PCT Application No. PCT/JP2020/031324 dated Mar. 24, 2022.

* cited by examiner

SCROLL COMPRESSOR

CROSS-REFERENCE TO RELATED APPLICATIONS

This is a continuation of International Application No. PCT/JP2020/031324 filed on Aug. 19, 2020, which claims priority to Japanese Patent Application No. 2019-167368, filed on Sep. 13, 2019. The entire disclosures of these applications are incorporated by reference herein.

BACKGROUND

Field of Invention

The present disclosure relates to a scroll compressor.

Background Information

Japanese Unexamined Patent Publication No. 2012-77616 discloses a scroll compressor configured to switch between a state in which only a fixed-side oil groove and a movable-side oil groove communicate with each other, and a state in which the movable-side oil groove communicates with both of the fixed-side oil groove and a compression chamber at the same time, during rotation of a movable scroll.

SUMMARY

A first aspect of the present disclosure is directed to a scroll compressor including fixed and movable scrolls forming a compression chamber, a back pressure chamber, and outer and inner oil supply mechanisms. The back pressure chamber allows an intermediate pressure between a suction pressure and a discharge pressure of the compression chamber to act on a surface of the movable scroll opposite to a sliding surface of the movable scroll. The outer oil supply mechanism is configured to supply oil to an outer chamber of the compression chamber located radially outward of a wrap of the movable scroll. The inner oil supply mechanism is configured to supply oil to an inner chamber of the compression chamber located radially inward of the wrap of the movable scroll. The inner oil supply mechanism includes an oil supply portion and a communication port. The oil supply portion is formed in a sliding surface of the fixed scroll to communicate with a suction region of the compression chamber. The communication port passes through the sliding surface of the movable scroll to communicate with the back pressure chamber. The communication port communicates with the oil supply portion within a predetermined period in which a center position of a suction-side end of the wrap of the movable scroll in a thickness direction is located radially outward of a center position of a space between adjacent turns of a wrap of the fixed scroll, during one rotation of the movable scroll.

DETAILED DESCRIPTION OF EMBODIMENT(S)

Embodiment

An embodiment will be described below.

Figure 1:
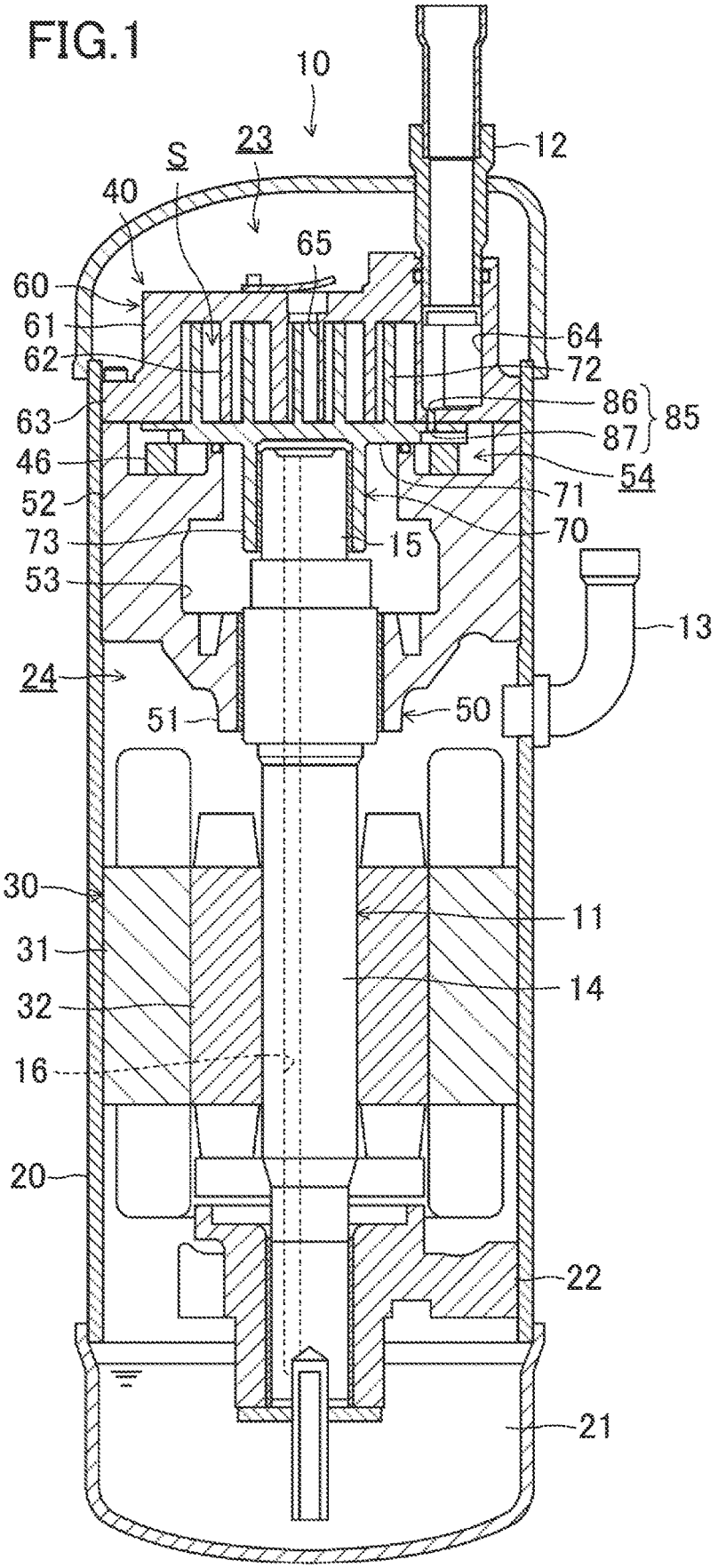
FIG. 1 is a diagram illustrating a longitudinal sectional view of a configuration of a scroll compressor according to this embodiment.

As shown in FIG. 1, a scroll compressor (10) is placed in a refrigerant circuit of a vapor compression refrigeration cycle. In this refrigerant circuit, a refrigerant compressed in the scroll compressor (10) condenses in a condenser, has its pressure decreased in a decompression mechanism, evaporates in an evaporator, and is then sucked into the scroll compressor (10).

The scroll compressor (10) includes a casing (20), and an electric motor (30) and a compression mechanism (40) housed in the casing (20). The casing (20) has a vertically oriented cylindrical shape, and is configured as a closed dome.

The electric motor (30) includes a stator (31) fixed to the casing (20) and a rotor (32) inside the stator (31). The rotor (32) is fixed to a drive shaft (11).

The casing (20) has, at its bottom, an oil reservoir (21) for storing oil. A suction pipe (12) is connected to an upper portion of the casing (20). A discharge pipe (13) is connected to a barrel of the casing (20).

A housing (50) is fixed to the casing (20). The housing (50) is located above the electric motor (30). The compression mechanism (40) is located above the housing (50). The discharge pipe (13) has an inflow end between the electric motor (30) and the housing (50).

The drive shaft (11) extends vertically along the center axis of the casing (20). The drive shaft (11) includes a main shaft portion (14) and an eccentric portion (15) provided at the upper end of the main shaft portion (14).

The main shaft portion (14) has a lower portion rotatably supported by a lower bearing (22). The lower bearing (22) is fixed to the inner circumferential surface of the casing (20). The main shaft portion (14) has an upper portion extending so as to pass through the housing (50) and rotatably supported by an upper bearing (51) of the housing (50).

The compression mechanism (40) includes a fixed scroll (60) and a movable scroll (70). The fixed scroll (60) is fixed to the upper surface of the housing (50). The movable scroll (70) is interposed between the fixed scroll (60) and the housing (50).

The housing (50) includes an annular portion (52) and a recess (53). The annular portion (52) forms the outer circumference of the housing (50). The recess (53) is provided in a central upper portion of the housing (50). The upper bearing (51) is located below the recess (53).

The housing (50) is fixed to the inside of the casing (20). The inner circumferential surface of the casing (20) and the outer circumferential surface of the annular portion (52) of the housing (50) are in airtight contact with each other throughout the entire circumference. The housing (50) partitions the interior of the casing (20) into an upper space (23) in which the compression mechanism (40) is housed and a lower space (24) in which the electric motor (30) is housed.

Figure 2:
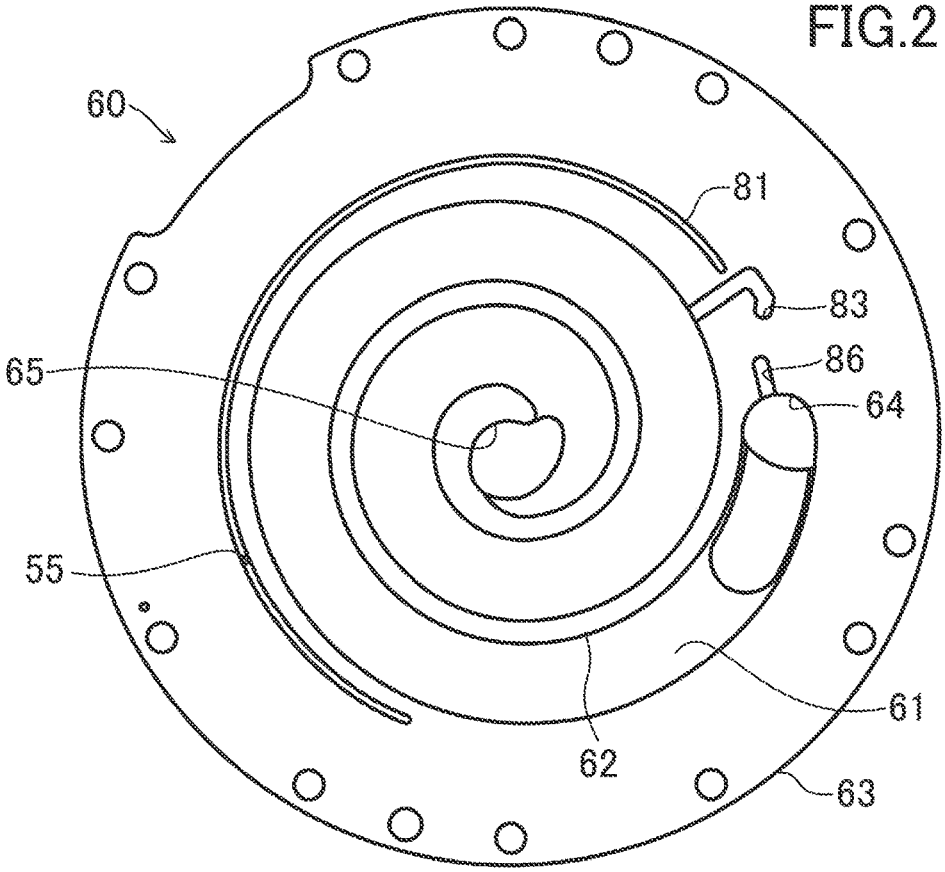
FIG. 2 is a diagram illustrating a bottom view of a configuration of a fixed scroll.

The fixed scroll (60) includes a fixed-side end plate (61), an outer circumferential wall (63) in a substantially cylindrical shape which stands on the outer edge of the lower surface of the fixed-side end plate (61), and a spiral fixed-side wrap (62) which stands inside the outer circumferential wall (63) of the fixed-side end plate (61) (see FIG. 2).

The fixed-side end plate (61) is located on the outer circumference and continuous with the fixed-side wrap (62). The end surface of the fixed-side wrap (62) and the end surface of the outer circumferential wall (63) are substantially flush with each other. The fixed scroll (60) is fixed to the housing (50).

Figure 3:
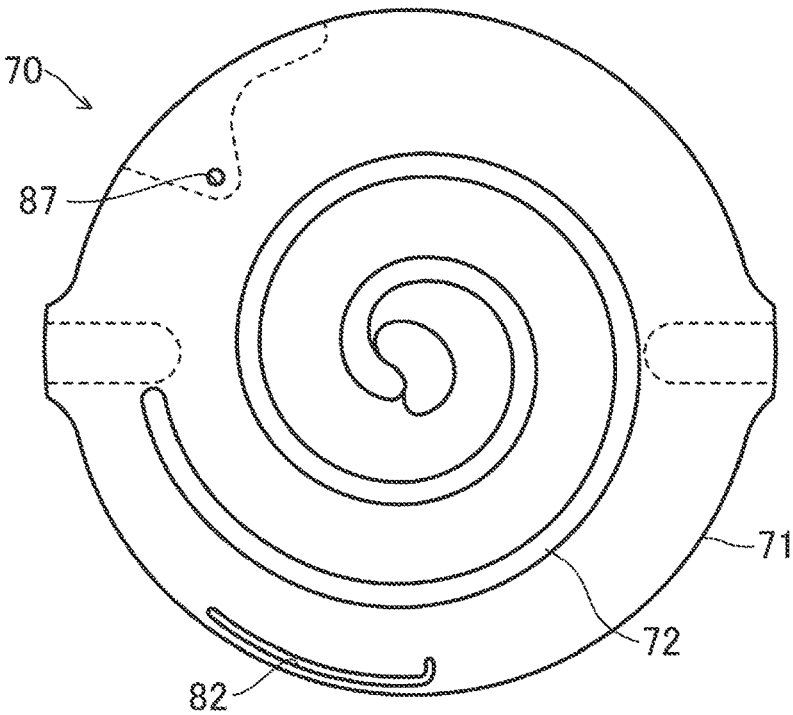
FIG. 3 is a diagram illustrating a top view of a configuration of a movable scroll.

The movable scroll (70) includes a movable-side end plate (71), a spiral movable-side wrap (72) located on the upper surface of the movable-side end plate (71), and a boss (73) located at a central portion of the lower surface of the movable-side end plate (71) (see FIG. 3).

The eccentric portion (15) of the drive shaft (11) is inserted into the boss (73), whereby the boss (73) is connected to the drive shaft (11). An annular recess is formed in a portion of the upper portion of the housing (50) radially outside the recess (53). A back pressure chamber (54) is defined by the annular recess in the upper portion of the housing (50), the fixed scroll (60), and the movable scroll (70).

An intermediate-pressure refrigerant is supplied from a compression chamber (S) in the course of compression to the back pressure chamber (54). The back pressure chamber (54) has an atmosphere with an intermediate pressure between the suction pressure and discharge pressure of the compression chamber (S). The intermediate pressure of the back pressure chamber (54) acts on the back surface of the movable scroll (70). An Oldham coupling (46) is provided in the back pressure chamber (54). The Oldham coupling (46) blocks the rotation of the movable scroll (70) on its axis.

The compression mechanism (40) includes, between the fixed scroll (60) and the movable scroll (70), the compression chamber (S) into which a refrigerant flows. The movable scroll (70) is placed so that the movable-side wrap (72) meshes with the fixed-side wrap (62) of the fixed scroll (60). Here, the lower surface of the outer circumferential wall (63) of the fixed scroll (60) serves as a sliding surface that faces the movable scroll (70). On the other hand, the upper surface of the movable-side end plate (71) of the movable scroll (70) serves as a sliding surface that faces the fixed scroll (60).

A suction port (64) that communicates with the compression chamber (S) is formed in the outer circumferential wall (63) of the fixed scroll (60). The suction pipe (12) is connected to the upstream side of the suction port (64).

The compression chamber (S) is partitioned into an outer chamber (S1) located radially outward of the movable scroll (70) and inner chambers (S2) located radially inward of the movable scroll (70). Specifically, when the inner circumferential surface of the outer circumferential wall (63) of the fixed scroll (60) and the outer circumferential surface of the movable-side wrap (72) of the movable scroll (70) substantially come into contact with each other, the outer chamber (S1) and the inner chambers (S2) become separate sections with the contact portion serving as a boundary (see, e.g., FIG. 5).

The fixed-side end plate (61) of the fixed scroll (60) has, at its center, an outlet (65). The high-pressure refrigerant compressed by the compression mechanism (40) flows out of the compression mechanism (40) to the lower space (24) via a path (not shown) formed through the fixed-side end plate (61) of the fixed scroll (60) and the housing (50).

An oil supply hole (16) is provided inside the drive shaft (11) so as to extend vertically from the lower end to the upper end of the drive shaft (11). A lower end portion of the drive shaft (11) is immersed in the oil reservoir (21). The oil supply hole (16) supplies the oil in the oil reservoir (21) to the lower bearing (22) and the upper bearing (51), and to the gap between the boss (73) and the drive shaft (11). The oil supply hole (16) is open to the upper end surface of the drive shaft (11) and supplies oil to above the drive shaft (11).

The recess (53) of the housing (50) communicates with the oil supply hole (16) of the drive shaft (11) via the inside of the boss (73) of the movable scroll (70). The high-pressure oil is supplied to the recess (53), so that a high pressure equivalent to the discharge pressure of the compression mechanism (40) acts on the recess (53). The movable scroll (70) is pressed onto the fixed scroll (60) by the high pressure that acts on the recess (53).

An oil path (55) is provided in the housing (50) and the fixed scroll (60). The oil path (55) has an inflow end that communicates with the recess (53) of the housing (50) (not shown). The oil path (55) has an outflow end open to the sliding surface of the fixed scroll (60). Through the oil path (55), the high-pressure oil in the recess (53) is supplied to the sliding surfaces of the movable-side end plate (71) of the movable scroll (70) and the outer circumferential wall (63) of the fixed scroll (60).

Configurations of Outer Oil Supply Mechanism, Inner Oil Supply Mechanism, and Intermediate-Pressure Groove As illustrated in FIG. 2, the sliding surface of the outer circumferential wall (63) of the fixed scroll (60) has a fixed-side oil groove (81) serving as an outer oil supply mechanism (80), an oil supply groove (86)(an oil supply portion) serving as an inner oil supply mechanism (85), and an intermediate-pressure groove (83) (an intermediate-pressure portion).

The fixed-side oil groove (81) is formed in the sliding surface, of the outer circumferential wall (63) of the fixed scroll (60), which faces the movable-side end plate (71) of the movable scroll (70). The fixed-side oil groove (81) extends substantially in an arc shape along the inner circumferential surface of the outer circumferential wall (63) of the fixed scroll (60). The oil path (55) communicates with the fixed-side oil groove (81), and oil is supplied to the fixed-side oil groove (81) from the oil path (55).

The oil supply groove (86) extends along the circumferential direction of the fixed scroll (60). The oil supply groove (86) has one end that communicates with the suction port (64). Note that the oil supply groove (86) merely needs to communicate with a suction region of the compression chamber (S) upstream of the suction-side end of the movable-side wrap (72).

The intermediate-pressure groove (83) is formed between the fixed-side oil groove (81) and the oil supply groove (86). The intermediate-pressure groove (83) has one end that communicates with the compression chamber (S) in the course of compression (under intermediate pressure).

As illustrated in FIG. 3, the sliding surface of the movable-side end plate (71) of the movable scroll (70) has a movable-side oil groove (82) serving as the outer oil supply mechanism (80), and a communication port (87) serving as the inner oil supply mechanism (85).

The movable-side oil groove (82) is formed near an end portion of the fixed-side oil groove (81) of the fixed scroll (60). The movable-side oil groove (82) is substantially arc-shaped. An end portion of the movable-side oil groove (82) closer to the fixed-side oil groove (81) is bent and extends toward the center of the movable scroll (70). The movable-side oil groove (82) communicates with the fixed-side oil groove (81) and the outer chamber (S1) of the compression chamber (S) during one rotation of the movable scroll (70).

The communication port (87) passes through an outer peripheral portion of the movable-side end plate (71) in the thickness direction thereof. The communication port (87) allows the sliding surface of the movable scroll (70) and the back pressure chamber (54) to communicate with each other.

Figure 4:
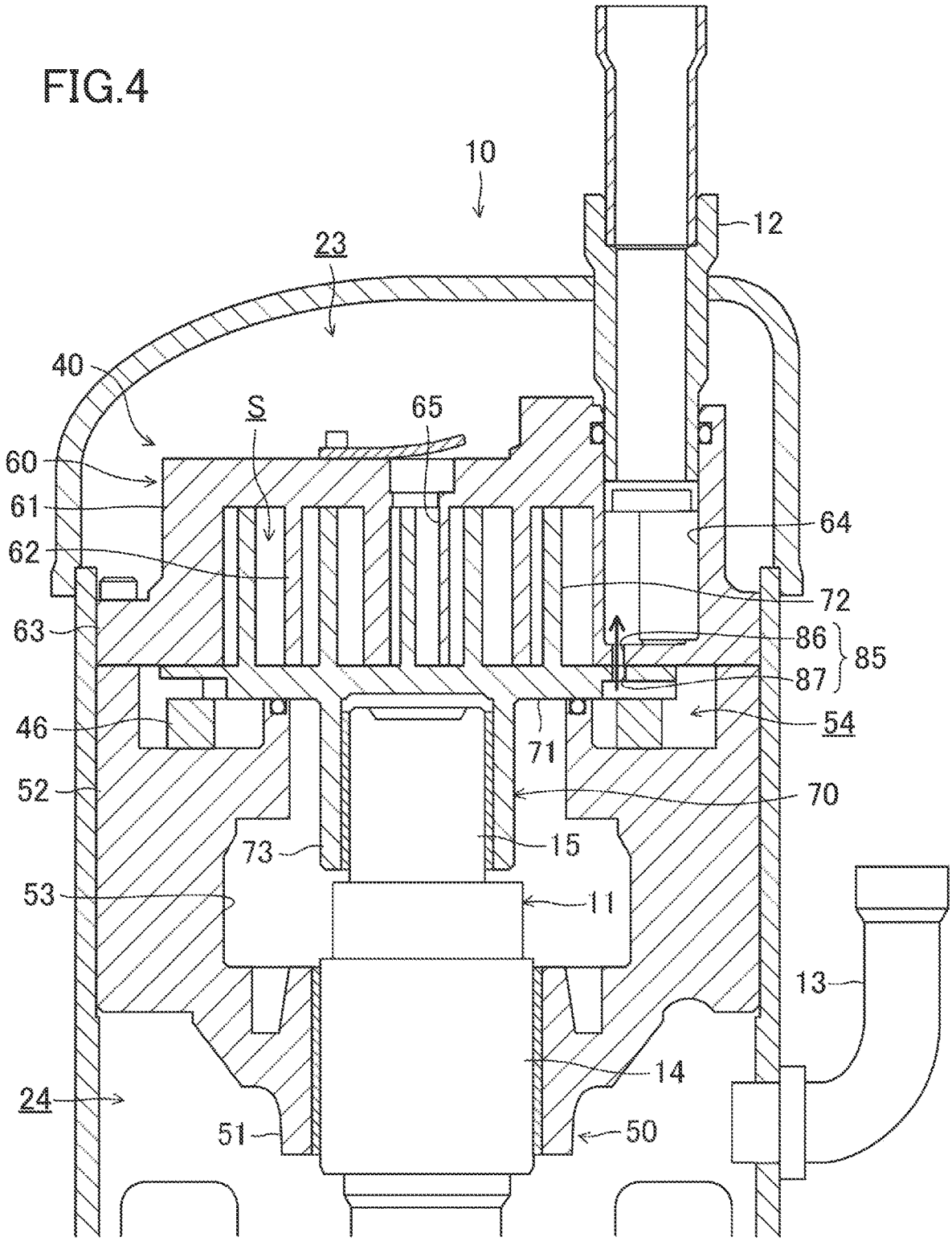
FIG. 4 is a diagram illustrating a longitudinal sectional view of an enlarged main part of the scroll compressor.

The communication port (87) of the movable scroll (70) communicating with the oil supply groove (86) of the fixed scroll (60) as indicated by the arrow in FIG. 4 allows oil in the back pressure chamber (54) to be supplied to the suction port (64).

The compression mechanism (40) performs an inner oil supply operation for supplying oil to the inner chambers (S2), an outer oil supply operation for supplying oil to the outer chambers (S1), and a back pressure adjusting operation for supplying the intermediate-pressure refrigerant to the back pressure chamber (54). Specifically, the compression mechanism (40) sequentially repeats the inner oil supply operation, the outer oil supply operation, and the back pressure adjusting operation during one rotation of the movable scroll (70).

Operation

A basic operation of the scroll compressor (10) will be described. When activated, the electric motor (30) rotatably drives the movable scroll (70) of the compression mechanism (40). Since the rotation of the movable scroll (70) is blocked by the Oldham coupling (46), the movable scroll (70) performs only the eccentric rotation about the axis of the drive shaft (11).

As illustrated in FIGS. 5 to 8, the eccentric rotation of the movable scroll (70) partitions the compression chamber (S) into the outer chamber (S1) and the inner chambers (S2). The plurality of inner chambers (S2) are formed between the fixed-side wrap (62) of the fixed scroll (60) and the movable-side wrap (72) of the movable scroll (70). As the movable scroll (70) rotates eccentrically, these inner chambers (S2) gradually come closer to the center (i.e., the outlet (65)) and the volumes of these inner chambers (S2) gradually decrease. The refrigerant is gradually compressed in the inner chambers (S2) in this manner.

When the inner chamber (S2) with the minimum volume communicates with the outlet (65), the high-pressure gas refrigerant in the inner chamber (S2) is discharged from the outlet (65). The high-pressure gas refrigerant flows out to the lower space (24) via the path formed in the fixed scroll (60) and the path formed in the housing (50). The high-pressure gas refrigerant in the lower space (24) is discharged outside the casing (20) via the discharge pipe (13).

Oil Supply Operation

Next, an oil supply operation of the scroll compressor (10) will be described in detail with reference to FIGS. 4 to 8.

Once the high-pressure gas refrigerant flows out to the lower space (24) of the scroll compressor (10), the lower space (24) becomes a high-pressure atmosphere, and the pressure of the oil in the oil reservoir (21) increases. The high-pressure oil in the oil reservoir (21) flows upward through the oil supply hole (16) of the drive shaft (11) and flows out from the opening at the upper end of the eccentric portion (15) of the drive shaft (11) to the inside of the boss (73) of the movable scroll (70).

The oil supplied to the boss (73) is supplied to the gap between the eccentric portion (15) of the drive shaft (11) and the boss (73). Accordingly, the recess (53) of the housing (50) becomes a high-pressure atmosphere equivalent to the discharge pressure of the compression mechanism (40). The high pressure of the recess (53) presses the movable scroll (70) onto the fixed scroll (60).

The high-pressure oil accumulated in the recess (53) flows out through the oil path (55) to the fixed-side oil groove (81) (not shown). Accordingly, the oil with the high pressure equivalent to the discharge pressure of the compression mechanism (40) is supplied to the fixed-side oil groove (81).

An intermediate-pressure refrigerant is intermittently supplied from the compression chamber (S) under intermediate pressure to the back pressure chamber (54). As a result, the back pressure chamber (54) has an atmosphere with a predetermined intermediate pressure.

The inner oil supply operation, the outer oil supply operation, and the back pressure adjusting operation are sequentially performed as the movable scroll (70) rotates eccentrically in this state. In all of these operations, the oil in the fixed-side oil groove (81) is used to lubricate the sliding surfaces around the fixed-side oil groove (81).

Inner Oil Supply Operation

Figure 5:
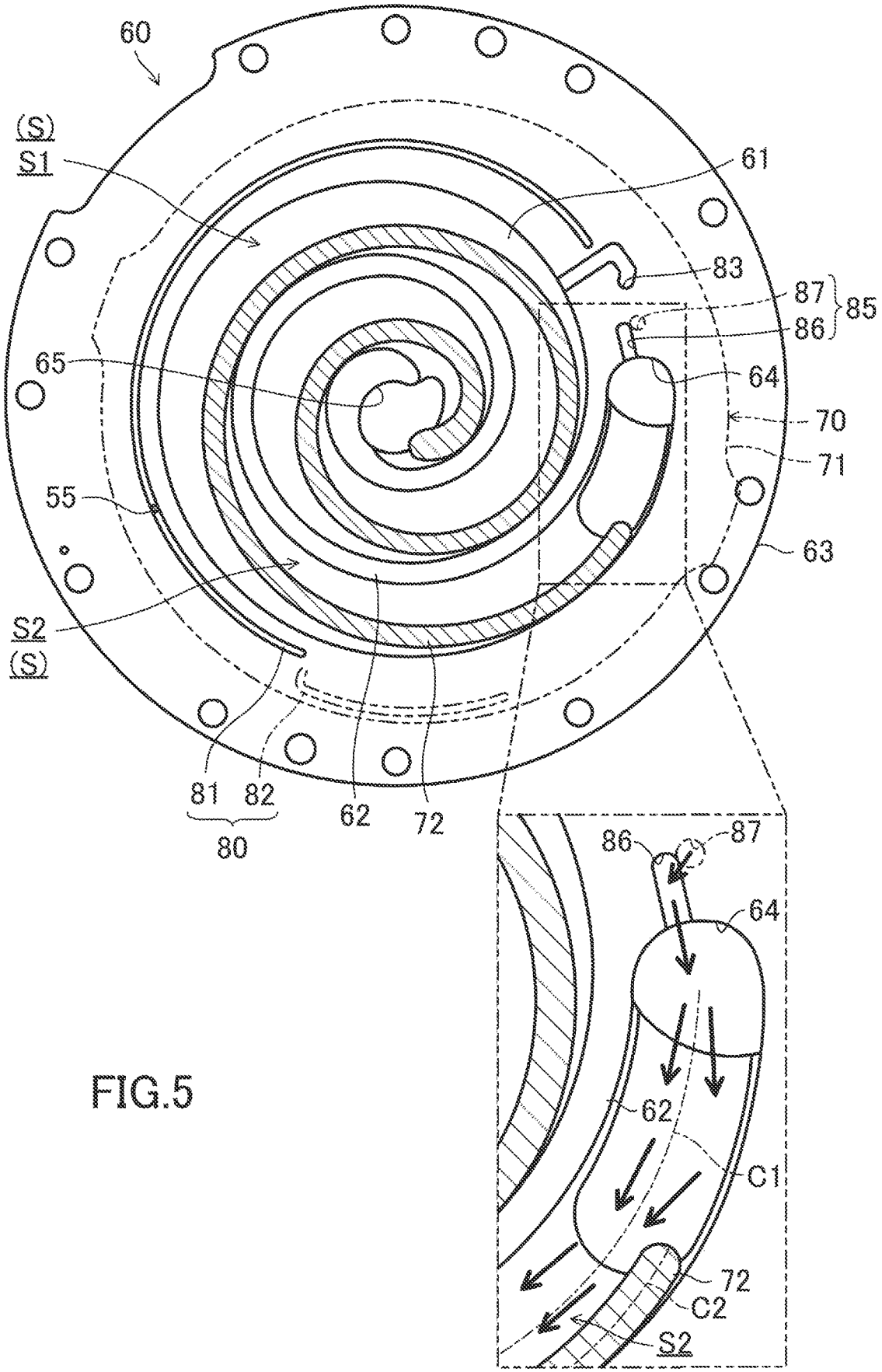
FIG. 5 is a diagram illustrating how oil flows at the beginning of communication between a communication port and a fixed-side oil groove.

The inner oil supply operation is performed when the movable scroll (70) reaches the eccentric angular position illustrated in, for example, FIG. 5. In the inner oil supply operation, the communication port (87) and the oil supply groove (86) communicate with each other, and the oil in the back pressure chamber (54) is supplied to the oil supply groove (86). The oil supplied to the oil supply groove (86) is supplied to the suction port (64) of the compression chamber (S).

Here, in this embodiment, to facilitate supplying oil toward the inner chambers (S2), the period during which the communication port (87) and the oil supply groove (86) communicate with each other is set as appropriate.

Specifically, the communication port (87) and the oil supply groove (86) are determined to communicate with each other within a predetermined period in which the center position (C2) of a suction-side end of the movable-side wrap (72) in the thickness direction is located radially outward of the center position (C1) of the space between adjacent turns of the fixed-side wrap (62).

In the example illustrated in FIG. 5, the communication port (87) and the oil supply groove (86) start communicating with each other when the suction of the refrigerant is completely blocked by the movable scroll (70). The period in which the communication port (87) and the oil supply groove (86) communicate with each other is determined by setting the position of the communication port (87) and the width of the oil supply groove (86) as appropriate.

Thus, the oil in the back pressure chamber (54) flows through the communication port (87), the oil supply groove (86), and the suction port (64) toward the inner chambers (S2) as indicated by the arrows in FIG. 5. This can improve the oil sealing performances of the inner chambers (S2).

Figure 6:
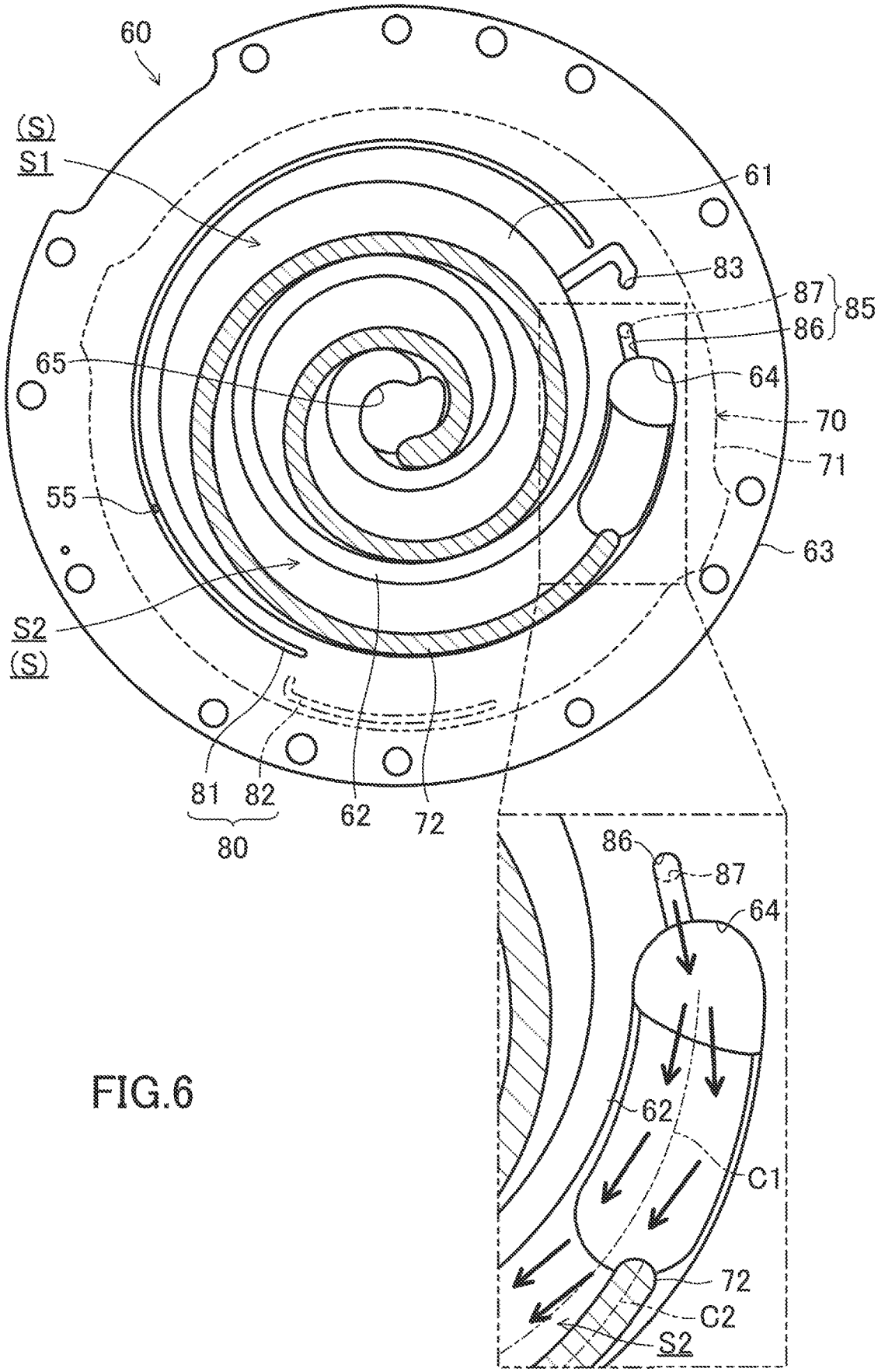
FIG. 6 is a diagram illustrating how oil flows during communication between the communication port and the fixed-side oil groove.

When the movable scroll (70) in the eccentric angular position illustrated in FIG. 5 further rotates eccentrically, for example, to the eccentric angular position illustrated in FIG. 6, the entire communication port (87) is located within the oil supply groove (86). At this timing, as well, the center position (C2) of the movable-side wrap (72) is located radially outward of the center position (C1) of the space between adjacent turns of the fixed-side wrap (62). This facilitates supplying oil to the inner chambers (S2) (see the arrows in FIG. 6).

Figure 7:
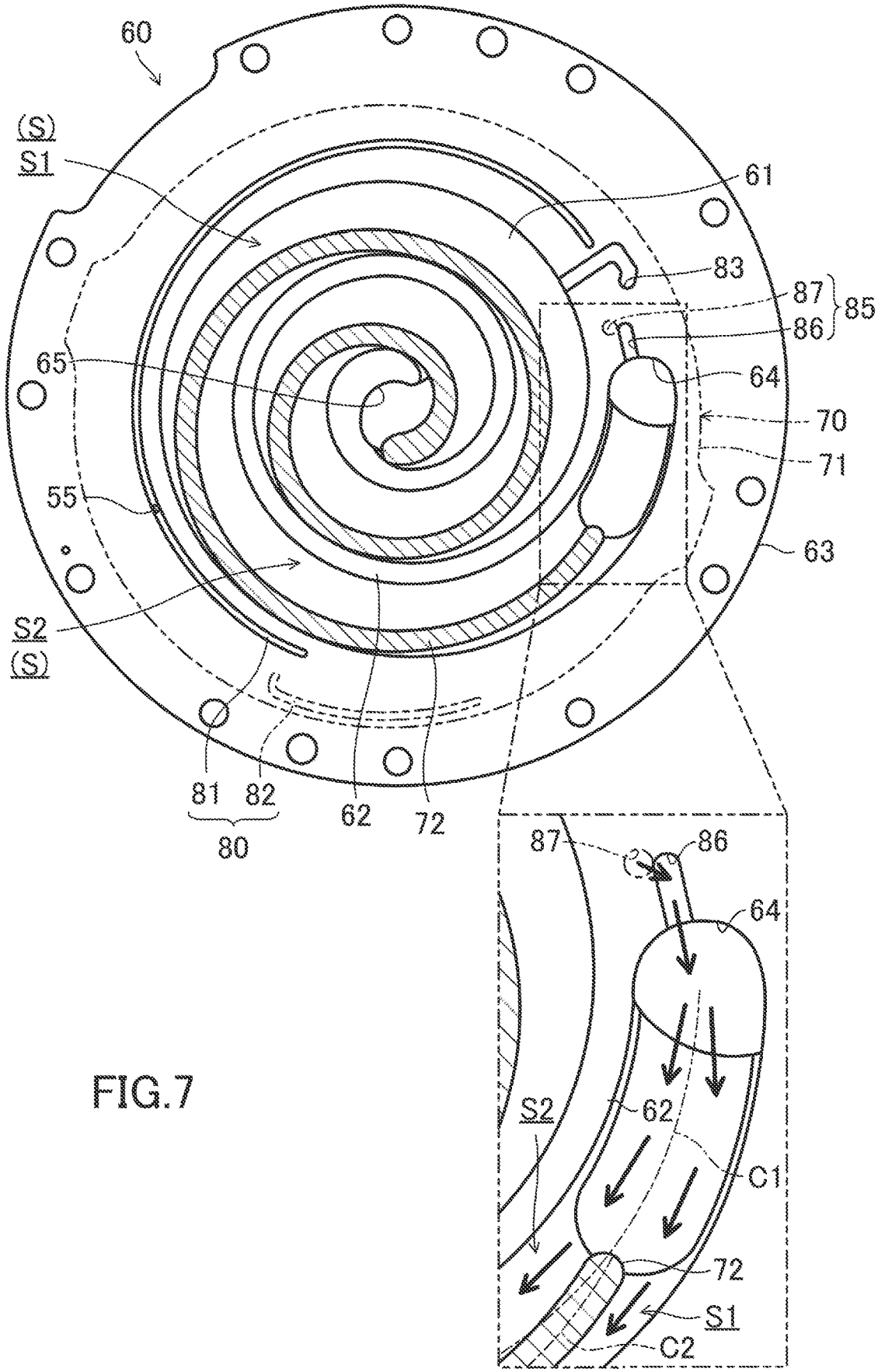
FIG. 7 is a diagram illustrating how oil flows immediately before the end of the communication between the communication port and the fixed-side oil groove.

When the movable scroll (70) in the eccentric angular position illustrated in FIG. 6 further rotates eccentrically, for example, to the eccentric angular position illustrated in FIG. 7, the communication port (87) and the oil supply groove (86) are immediately before ending communication with each other. At this timing, the center position (C2) of the movable-side wrap (72) and the center position (C1) of the space between adjacent turns of the fixed-side wrap (62) substantially coincide with each other. This allows oil to be distributed to the inner chambers (S2) and the outer chamber (S1) (see the arrows in FIG. 7).

Outer Oil Supply Operation

Figure 8:
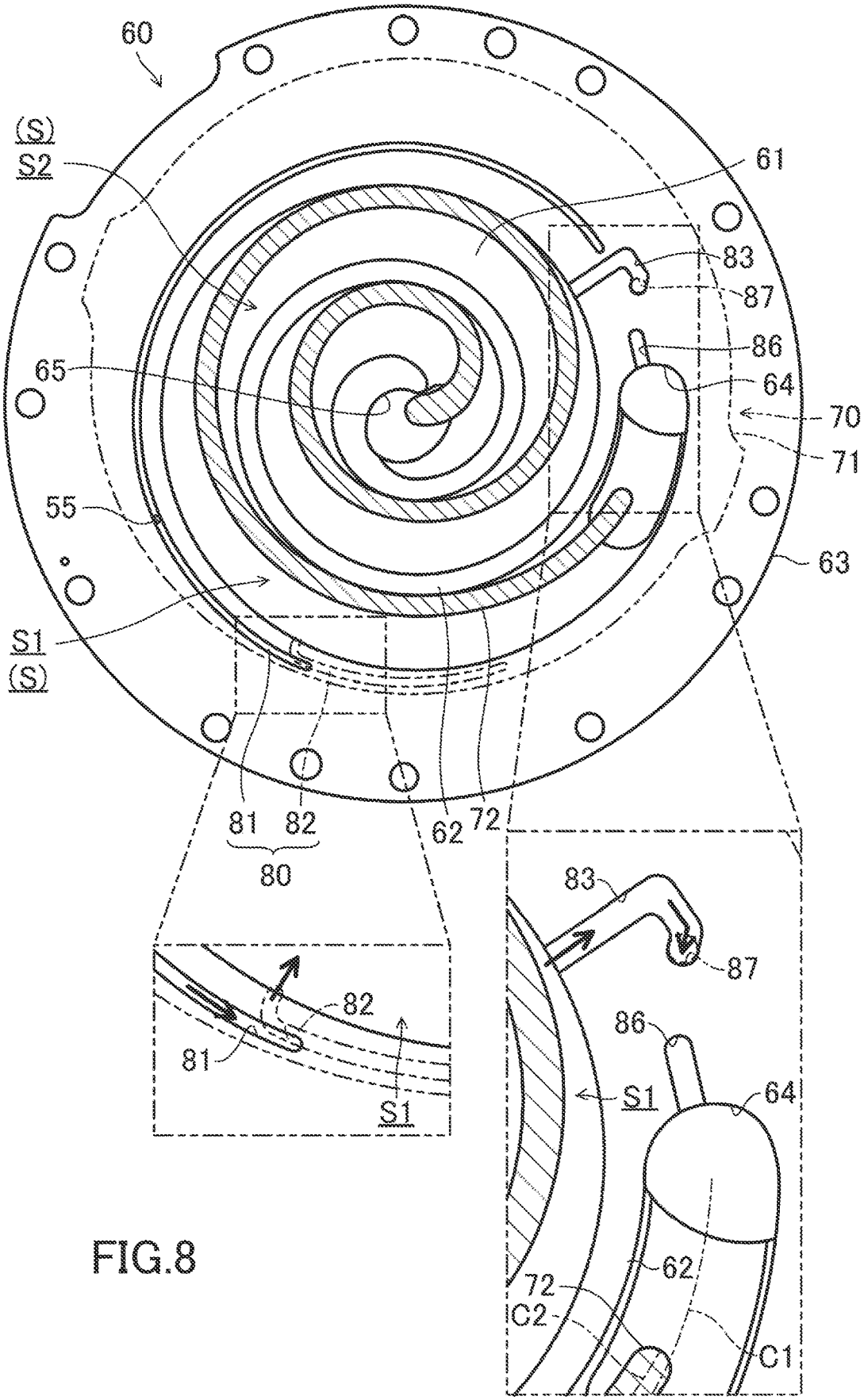
FIG. 8 is a diagram illustrating a state in which an outer oil supply operation and a back pressure adjusting operation are being performed.

The outer oil supply operation is performed when the movable scroll (70) in the eccentric angular position illustrated in FIG. 7 further rotates eccentrically, for example, to the eccentric angular position illustrated in FIG. 8. In the outer oil supply operation, the fixed-side oil groove (81) and the movable-side oil groove (82) communicate with each other, and the oil in the fixed-side oil groove (81) is delivered to the movable-side oil groove (82). Since a portion of the movable-side oil groove (82) bent radially inward communicates with the outer chamber (S1) at this moment, the oil in the movable-side oil groove (82) is supplied to the outer chamber (S1). This can improve the oil sealing performances of the outer chamber (S1).

Back Pressure Adjusting Operation

When the movable scroll (70) is in the eccentric angular position illustrated in FIG. 8, the back pressure adjusting operation is also performed. In the back pressure adjusting operation, the communication port (87) and the intermediate-pressure groove (83) communicate with each other. Thus, the refrigerant in the outer chamber (S1) under intermediate pressure is supplied through the intermediate-pressure groove (83) and the communication port (87) to the back pressure chamber (54). As a result, the back pressure chamber (54) has an atmosphere with a predetermined intermediate pressure.

Figure 9:
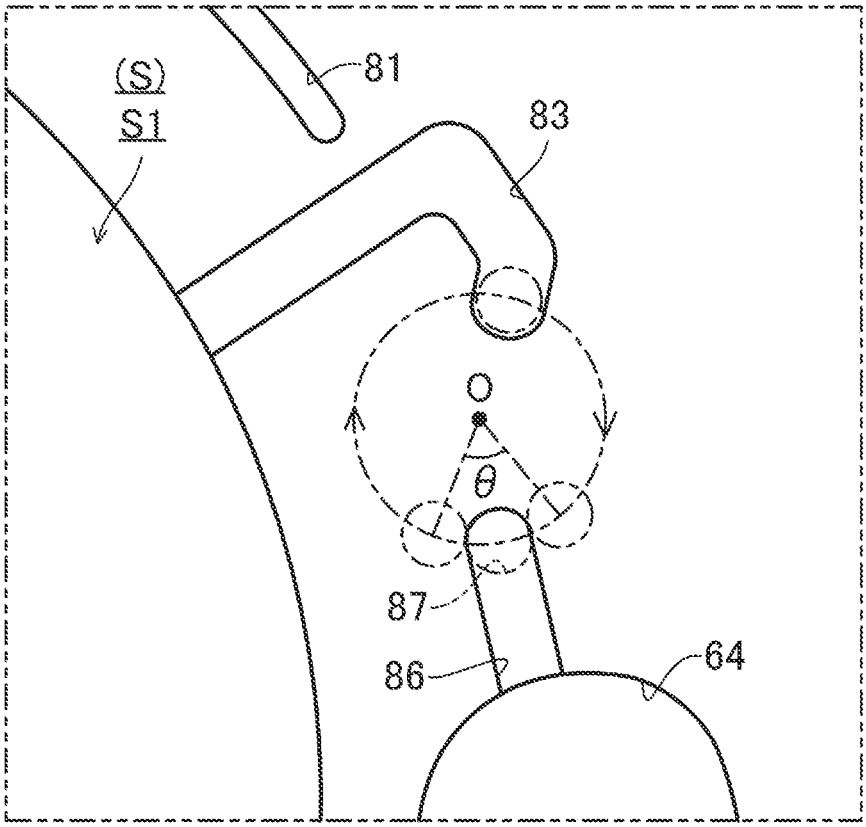
FIG. 9 is a diagram for explaining a period during which the communication port and an oil supply groove communicate with each other.

As shown also in FIG. 9, after the back pressure adjusting operation, the inner oil supply operation is performed again. Thereafter, the outer oil supply operation and the back pressure adjusting operation are sequentially repeated.

In this embodiment, the period in which the communication port (87) and the oil supply groove (86) communicate with each other is set with reference to an angle at which the suction of the refrigerant into the outer chamber (S1) is completely blocked.

Specifically, the communication port (87) communicates with the oil supply groove (86) within a predetermined period in which the movable scroll (70) rotates in a range of from 0° to 100°, where 0° is the angle at which the suction into the outer chamber (S1) is completely blocked. The predetermined period as used herein is represented by the rotational angle θ of the movable scroll (70), and is determined by the position of the communication port (87) and the width of the oil supply groove (86).

Thus, oil can be supplied to the inner chamber (S2) of the compression chamber (S) at predetermined timing.

Advantages of Embodiment

The scroll compressor (10) of this embodiment includes the fixed scroll (60), and the movable scroll (70) that forms the compression chamber (S) with the fixed scroll (60). This scroll compressor (10) includes: a back pressure chamber (54) allowing an intermediate pressure between a suction pressure and a discharge pressure of the compression chamber (S) to act on a surface of the movable scroll (70) opposite to a sliding surface of the movable scroll (70); an outer oil supply mechanism (80) configured to supply oil to an outer chamber (S1) of the compression chamber (S) located radially outward of a movable-side wrap (72) of the movable scroll (70); and an inner oil supply mechanism (85) configured to supply oil to an inner chamber (S2) of the compression chamber (S) located radially inward of the movable-side wrap (72) of the movable scroll (70), wherein the inner oil supply mechanism (85) includes an oil supply groove (86) (oil supply portion) and a communication port (87), the oil supply portion (86) being formed in a sliding surface of the fixed scroll (60) to communicate with a suction region of the compression chamber (S), the communication port (87) passing through the sliding surface of the movable scroll (70) to communicate with the back pressure chamber (54), and the communication port (87) communicates with the oil supply groove (86) within a predetermined period in which a center position (C2) of a suction-side end of the wrap (72) of the movable scroll (70) in a thickness direction is located radially outward of a center position (C1) of a space between adjacent turns of a wrap of the fixed scroll (60), during one rotation of the movable scroll (70).

In this embodiment, the outer oil supply mechanism (80) configured to supply oil to the outer chamber (S1) of the compression chamber (S) and the inner oil supply mechanism (85) configured to supply oil to the inner chambers (S2) are provided. The inner oil supply mechanism (85) has the oil supply groove (86) and the communication port (87). The communication port (87) and the oil supply groove (86) communicate with each other within the predetermined period in which the center position (C2) of the suction-side end of the wrap (72) of the movable scroll (70) in the thickness direction is located radially outward of the center position (C1) of the space between adjacent turns of the wrap of the fixed scroll (60).

Accordingly, oil can be supplied to the spaces in the compression chamber (S) which are located radially inward and outward of the movable scroll (70).

The scroll compressor (10) of this embodiment has the intermediate-pressure groove (83) (intermediate-pressure portion) formed in the sliding surface of the movable scroll (70) to communicate with the compression chamber (S) in the course of compression. The communication port (87) communicates alternately with the oil supply groove (86) and the intermediate-pressure groove (83) during one rotation of the movable scroll (70).

In this embodiment, the communication port (87) communicates with the oil supply groove (86) and the intermediate-pressure groove (83) alternately during one rotation of the movable scroll (70).

Thus, an intermediate-pressure refrigerant is intermittently supplied from the compression chamber (S) under intermediate pressure to the back pressure chamber (54). This allows the back pressure chamber (54) to have an atmosphere with a predetermined intermediate pressure.

The scroll compressor (10) of this embodiment is configured such that the communication port (87) communicates with the oil supply groove (86) within the predetermined period in which the movable scroll (70) rotates in the range of from 0° to 100°, where 0° is the angle at which the suction into the outer chamber (S1) is completely blocked.

In this embodiment, the period in which the communication port (87) and the oil supply groove (86) communicate with each other is set with reference to the angle at which the suction into the outer chamber (S1) is completely blocked. Thus, oil can be supplied to the inner chamber (S2) of the compression chamber (S) at predetermined timing.

While the embodiment and variations have been described above, it will be understood that various changes in form and details can be made without departing from the spirit and scope of the claims. The above embodiment and variations may be appropriately combined or replaced as long as the functions of the target of the present disclosure are not impaired.

As described above, the present disclosure is useful for a scroll compressor.

The invention claimed is:

1. A scroll compressor comprising:

a fixed scroll;

a movable scroll forming a compression chamber with the fixed scroll;

a back pressure chamber allowing an intermediate pressure between a suction pressure and a discharge pressure of the compression chamber to act on a surface of the movable scroll opposite to a sliding surface of the movable scroll;

an outer oil supply mechanism configured to supply oil to an outer chamber of the compression chamber located radially outward of a wrap of the movable scroll; and an inner oil supply mechanism configured to supply oil to an inner chamber of the compression chamber located radially inward of the wrap of the movable scroll, the inner oil supply mechanism including an oil supply portion and a communication port, the oil supply portion being formed in a sliding surface of the fixed scroll to communicate with a suction region of the compression chamber, the communication port passing through the sliding surface of the movable scroll to communicate with the back pressure chamber, and the communication port communicating with the oil supply portion within a predetermined period in which a center position of a suction-side end of the wrap of the movable scroll in a thickness direction is located radially outward of a center position of a space between adjacent turns of a wrap of the fixed scroll, during one rotation of the movable scroll.

2. The scroll compressor of claim 1, further comprising:

an intermediate-pressure portion formed in the sliding surface of the fixed scroll to communicate with the compression chamber in a course of compression, the communication port communicating alternately with the oil supply portion and the intermediate-pressure portion during one rotation of the movable scroll.

3. The scroll compressor of claim 2, wherein the communication port communicates with the oil supply portion within a predetermined period in which the movable scroll rotates in a range from 0° to 100°, where 0° is an angle at which suction into the outer chamber is completely blocked.

4. The scroll compressor of claim 1, wherein the communication port communicates with the oil supply portion within a predetermined period in which the movable scroll rotates in a range from 0° to 100°, where 0° is an angle at which suction into the outer chamber is completely blocked.

* * * * *